US005558150A

United States Patent [19]

Sponseller

[11] Patent Number: 5,558,150

[45] Date of Patent: Sep. 24, 1996

[54] METHOD OF PRODUCING A CAST MULTILAYERED ALLOY TUBE AND THE PRODUCT THEREOF

[75] Inventor: David L. Sponseller, Ann Arbor, Mich.

[73] Assignee: ERIM, Ann Arbor, Mich.

[21] Appl. No.: 451,412

[22] Filed: May 26, 1995

[51] Int. Cl.[6] ..... B22D 13/02; B22D 19/08

[52] U.S. Cl. ..... 164/95; 164/94; 164/98; 164/114

[58] Field of Search ..... 164/98, 94, 95, 164/114, 76.1; 29/527.7

[56] References Cited

FOREIGN PATENT DOCUMENTS

| | | | |
|---|---|---|---|
| 51-91822 | 8/1976 | Japan | 164/114 |
| 55-103265 | 8/1980 | Japan | 164/114 |
| 58-6765 | 1/1983 | Japan | 164/114 |

*Primary Examiner*—Kuang Y. Lin
*Attorney, Agent, or Firm*—Hopgood, Calimafde, Kalil & Judlowe

[57] ABSTRACT

A method is provided for producing by centrifugal casting an alloy tubular article of manufacture in the form of a composite tubular product comprised of an outer alloy layer (first alloy) and at least one inner alloy layer (second alloy) while substantially inhibiting the formation of a metallurgical bond between layers in the final casting. The product is produced using a rotatable centrifugal casting mold having a cylindrical inner surface adapted to receive a molten metal alloy. A first layer of an alloy is poured into the rotatable mold, the alloy having a melting point of at least about 1300° C. and generally at least about 1400° C. Centrifugally casting said alloy as an outer layer during rotation of said mold. The outer layer is solidified and cooled to a temperature not exceeding about 92% of its absolute melting point in degrees Kelvin. At least one inner layer is poured into the outer layer, the alloy of the inner having a melting point of at least about 1300° C. and generally at least about 1400° C. The centrifugally cast composite tubular metal product is cooled to ambient temperature to provide a composite tubular product in the as-cast condition characterized by an interface between the layers in which the formation of a metallurgical bond across the interface has been substantially inhibited. The composite casting may then by mechanically hot worked, such as by hot extrusion, to produce a composite tube in which the layers are metallurgically bonded to each other.

20 Claims, 3 Drawing Sheets

METHOD OF PRODUCING A CAST MULTILAYERED ALLOY TUBE AND THE PRODUCT THEREOF

This invention relates to an economical method for producing by centrifugal casting followed by hot mechanical working, such as by hot extrusion, a multilayered composite tube, for example a bimetallic or clad tube, characterized by an interface in the as-cast condition in which diffusion of one layer into the other at said interface is substantially inhibited and by an interface in the final product wherein the two layers are metallurgically bonded to each other.

The production of bimetallic or composite tube by centrifugal casting is well known.

In this connection, reference is made to U.S. Pat. No. 4,536,455 which issued on Aug. 20, 1985, entitled "Centrifugally Cast Double Layer Tube With Resistance to Carbon Deposition".

The purpose of the invention described in the patent is to provide a double-layer tube in which the inner layer is made of a metal composition that substantially inhibits the formation of carbon deposits on the surface thereof when fluid hydrocarbons pass through said tube at an elevated temperature to effect thermal cracking of the hydrocarbon.

The specific alloy material employed for the inner tube is one containing 1%–10% wt. % aluminum, the base metal of the inner tube being selected from the group consisting of austenitic steels, ferritic steels, austenitic and ferritic duplex-phase steels, low-alloy steels, Ni alloys, Ni—Cr alloys, Co alloys, Co—Cr alloys, or other similar alloys.

According to the patent, sufficient aluminum is added to the alloy of the inner tube so that prior to or during use, a thin aluminum oxide film is formed on the surface of the inner tube which prevents or inhibits the deposit of carbon on the inner surface thereof. The outer layer of the composite may be any heat resisting alloy, e.g., 25% Cr—20% Ni, 24% Cr—24% Ni—1.5% Nb, or Ni—Cr alloy, Co—Cr alloys or their modifications.

According to the disclosure, the outer and inner layers are formed by centrifugal casting.

In producing the double-layer tubing, the outer layer is first cast at a temperature of about 1450° C. to 1600° C. and the temperature of the inner face of the cast outer layer is measured by an infrared pyrometer. When the layer solidifies just below the liquidus temperature of the alloy (about 1395° C. for HK-40), the inner layer is cast.

In column 4 of the patent, lines 37–43, it is indicated that the inner and outer layers are combined metallurgically by centrifugal casting, whereby the interface between the layers are fused due to liquid/solid phase diffusion and thereby provide the required mechanical strength across the interface of the composite bi-metallic product.

Thus, according to the patent, the double-layer tube eliminates the risk of disbording by virtue of the fact that the inner and outer layers are combined together metallurgically by centrifugal casting, whereby the interface between the two layers are fused together by melt back of the outer solidified layer into the molten inner layer to provide the desired bond.

A disadvantage of the patented method is that the diffusion of one layer into the other tends to be quite substantial due to the melt back of the solidified outer layer such that the alloy composition at the inner side of the interface tends to be contaminated by the other composition, which is not desirable.

This will clearly appear from the disclosure in column 3 of the patent at lines 4 to 46. In preparing the outer layer for reception of the molten metal for producing the inner layer, the outer layer is cast into the centrifugal casting mold and allowed to cool to just below the liquid-solidus temperature at about 1395° C. for the HK-40 alloy, which corresponds to an absolute temperature of 1395° C.+273° C. or 1668° K.

According to the patent, prior to casting of the inner layer, the molten metal for the inner layer is maintained at a temperature in the range about 1500° C. to 1650° C.

The melting point of the HK-40 used for the outer layer is in the neighborhood of about 1450° C. (1723° K.) and, as stated above, is cooled to about 1395° C. (1668° K. ) after solidification. The alloy for the inner layer is poured at a temperature in the range of about 1500° C. to 1650° C. against the inner face of the outer layer to produce a fused interface of some depth due to meltback of the outer layer into the molten inner layer.

The ratio of 1668° K. to 1723° K. (the melting point of HK-40) is 0.968 or 96.8% of the absolute melting point of HK-40, which is quite high.

I have found that the foregoing conditions do not provide the kind of tubular composite for use as a billet in the production of hot mechanically worked or hot extruded tubular products.

I have now discovered a method whereby a hot extruded product can be produced in which the diffusion of one metal into the other across the interface during hot extrusion results in the achievement of a metallurgical bond.

OBJECTS OF THE INVENTION

It is thus an object of the invention to provide a cast composite tubular billet of two or more layers for use in the production of hot mechanically worked tubular products in which the diffusion across the interface between layers following casting and solidification of the inner layer is substantially inhibited, if not avoided.

Another object is to provide a method for producing the aforementioned billet.

A further object is to provide a method for producing a composite tubular billet of two or more layers in the as cast condition wherein melting back of the outermost layer is substantially inhibited during the casting of the inner layer within the cylindrical tube formed by the outer layer.

A still further object is to provide a method for producing a hot extruded tubular product comprised of at least two tubular layers of metal alloys in which metallurgical bonding exists between adjacent layers of the hot extruded tube.

These and other objects will more clearly appear when taken in light of the following disclosure and claims and the appended drawings.

THE DRAWINGS

Figure 4:
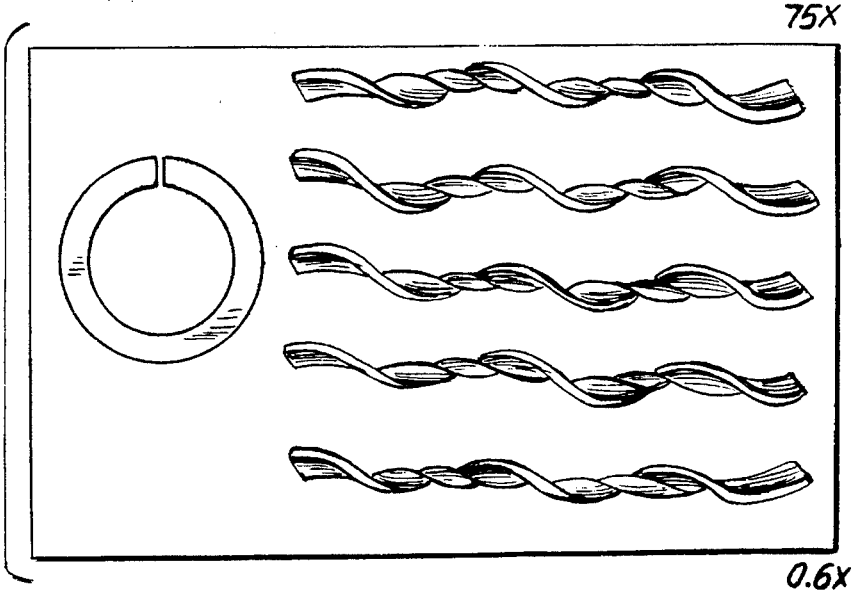
Figure 4A:
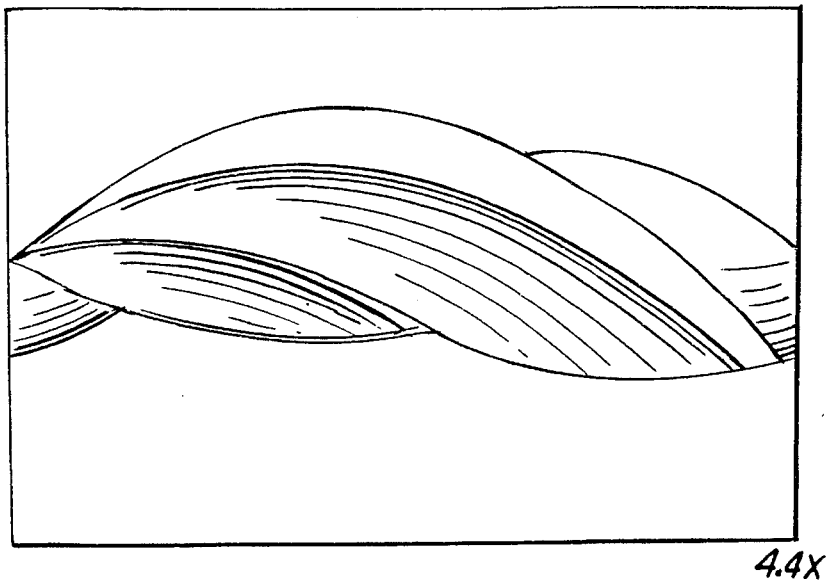

FIGS. 4 and 4A are illustrative of the mechanical strength of the bond between layers of the extruded product when a ring cut from the extruded tubular product is severed radially across a peripheral portion of the ring (note FIG. 4) and the ring is then helically twisted more than two full rotations without separation of the metallurgically bonded layers as shown in FIG. 4 at 0.6 times magnification and as shown in FIG. 4A at 4.4 times magnification.

SUMMARY OF THE INVENTION

Stating it broadly, a method is provided for producing by centrifugal casting an alloy tubular article of manufacture in the form of a composite heavy walled tube comprised of an outer alloy layer and at least one inner alloy layer while substantially inhibiting the formation of a metallurgical bond between layers in the as-cast condition.

The invention resides in providing a rotatable centrifugal casting mold having a cylindrical inner surface adapted to receive a molten metal alloy. The outer layer is produced by pouring into the mold during rotation thereof a first alloy composition of melting point at least about 1300° C. and generally at least about 1400° C. and centrifugally casting said alloy as an outer layer during rotation of said mold.

The outer or host layer is solidified and cooled to a temperature not exceeding about 92% of the absolute melting point of said alloy in degrees Kelvin. At least one second layer is poured into the hollow interior of the outer layer at a pouring temperature sufficient to form said second layer within the hollow interior of the first or host layer during rotation of the mold, said pouring temperature ranging from about 40° C. to about 75° C. above the melting point of the alloy.

By cooling the inner surface temperature of the first layer after solidification to not exceeding about 92% of its absolute melting point, substantial diffusion of said outer layer into the second layer by meltback is avoided such as to inhibit the substantial formation of a metallurgical bond between layers and thereby provide a casting of said composite tubular metal product in which the inner layer is generally mechanically held within the outer layer. Following the cooling of the centrifugally cast composite tubular metal product to ambient temperature, the composite tubular product in the as-cast condition is characterized by an interface between said layers in which the formation of a metallurgical bond across the interface has been substantially inhibited, if not avoided, the bonding being generally mechanical. (Note FIGS. 1, 1A and 1B)

DETAILS OF THE INVENTION

In carrying out the objectives of the invention, the alloys were prepared from the following raw materials: ARMCO iron, electrolytic nickel, molybdenum, ferrochromium, ferromanganese and ferrosilicon.

In the tests conducted, the outer layer comprised type 310 stainless steel and the inner layer was comprised of T-11 steel.

The SS310 alloy in percent by weight for six castings (A to F) had compositions of about 0.02 to 0.03C, 0.46 to 0.66 manganese, 0.19 to 0.32 Si, 24.89 to 25.21 Cr, 21.42 to 21.91 Ni, 0.015 to 0.033 P, 0.004 to 0.006 S and 0.050 to 0.106 N, balance Fe.

The T-11 alloy used in the six castings as the inner layer had compositions of 0.08 to 0.11 C, 0.28 to 0.44 Mn, 0.57 to 0.87 Si, 1.47 to 1.81 Cr, 0 to 0.17 Ni, 0.34 to 0.50 Mo, 0.015 to 0.04 P, 0.003 to 0.014 S and 0.067 to 0.078 N, balance Fe.

The weights of the SS310 heats ranged from about 500 to 550 lbs. The-weights of the T-11 heats ranged from about 965 to 1050 lbs, the outer layer in the final product being thinner than the inner layer.

SS310 has a melting point in the range of about 1400° C. to 1450° C. or an average melting point of about 1425° C.

In producing the SS310 alloy, the heats were deoxidized/desulfurized with Incocal (a Ni—Ca addition agent). The T-11 alloy was deoxidized with aluminum. The carbon content of the SS310 alloy was maintained quite low in order to prevent sensitization to corrosion. The nitrogen contents in both the SS310 and the T-11 alloy were relatively high.

In order to achieve the desired thickness of the outer and inner layers, a crane scale was used to control the tapping of an exact amount of each alloy into the respective ladle for pouring into the mold. A layer of vermiculite was used to help retain heat in the T-11 heats while waiting to be poured following pouring of the outer layer.

The centrifugal casting mold was made of a heavy-walled steel tubular body machined from a steel forging. The mold had an O.D. of 16 ¼ inch and an I.D. of 8 ⅝ inch, the bore length between end plates being about 112 inches, and rotated about a horizontal axis during casting.

Prior to casting the metal into the rotating mold, the inner surface of the mold is spray-coated with a layer of alumina powder and then preheated and dried to a mold temperature of about 500° F. (260° C.) at the time of casting.

The mold is subjected to a minimum rotational velocity of about 1315 rpm and a melt of SS310 at a pouring temperature ranging from about 2730° F. (1500° C.) to about 2830° F. (1555° C.) is poured through one end-plate of the spinning mold by means of a tundish.

Generally, the pouring temperature of each of the steels or alloys range from about 40° C. to 125° C. above the melting of the metal being poured, the outer layer being preferably poured at the higher end of the range and the inner layer at the lower end.

The SS310 alloy (i.e., the outer layer) is cast oversize, that is, to the I.D. of the mold of 8.5 inches (after coating of the mold), the final composite casting being then surface machined to a diameter of 8 inches to provide an extrusion billet that would readily fit into the liner of the extrusion press. To allow for the machining loss of the SS310 alloy in the oversized periphery of the tubular ingot, and still have enough SS310 alloy remaining to eventually achieve a cladding thickness of about 0.06 inch in the final 2-inch O.D. hot worked or extruded tubing, the quantity of SS310 alloy as shown in Table 1 was increased from 31% of the total casting weight in Castings A and B to 37% in Castings C, D and E, the amount in Casting F being increased to 39%. The six castings, A to F, were studied as will appear in Table 1 below.

TABLE 1

| ITEM SS310 Alloy | Casting A | Casting B | Casting C | Casting D | Casting E | Casting F |
|---|---|---|---|---|---|---|
| TAP, TEMP, °F. | 3050 (1677° C.) | 3050 (1677° C.) | 3050 (1677° C.) | 3080 (1693° C.) | 3040 (1671° C.) | 3050 (1677° C.) |
| Time between end of tap and start of pour (secs) | 124 | 122 | 200[1] | 232 | 86 | 127 |
| Pouring Temp in °F. | 2750 (1510° C.) | 2750 (1510° C.) | 2760 (1515° C.) | 2730 (1500° C.) | 2830 (1555° C.) | 2765 (1518° C.) |
| Pouring Time (secs.) | 19 | 22 | 17 | 27 | 36 | 17 |
| Nominal Percentage of casting weight | 31 | 31 | 37 | 37 | 37 | 39 |
| T-11 Alloy | | | | | | |
| Tap Temp °F. | 3070 (1688° C.) | 3000 (1649° C.) | 3050 (1677° C.) | 3080 (1693° C.) | 3070 (1688° C.) | 3060 (1682° C.) |
| Time between end of tap and start of pour (secs) | 329 | 225 | 324 | 373 | 234 | 320 |
| Time between end of SS310 pour and start of T-11 pour (secs) | 210 | 70 | 135 | 99 | 89 | 259 |
| Approx. Temp of SS310 inner surface at T-11 pour °F. | 2210[2] (1210° C.) | 2410 (1320° C.) | 2460 (1349° C.) | 2530 (1388° C.) | 2540 (1393° C.) | 2250[2] (1232° C.) |

[1]A layer of vermiculite was placed on top of the molten SS310 alloy.
[2]These temperatures were employed to avoid meltback.

Temperature measurements were made on the inner surface of the SS310 layer by an optical pyrometer immediately after the SS310 alloy was poured and solidified. For each casting, the temperature information is used to decide the moment at which the T-11 is to be poured. The approximate temperature (extrapolated) of the SS310 at the moment of the T-11 pour for each of the six castings is shown in Table 1, to have ranged from 2210° F. (1210° C.) for Casting A to 2540° F. (1393° C.) for Casting E. The SS310 temperatures for Castings A and F were well below those for the other four castings the goal being that no meltback of the SS310 layer occur during the T-11 pour for Casting A and Casting F.

About a minute before the T-11 alloy is due to be poured, its insulating vermiculite layer is removed. The T-11 is poured through a tundish into the end of the mold opposite from the end at which the SS310 alloy is poured.

As a result of the foregoing tests, it was noted that meltback of the outer layer at the T-11 pouring end causes some reduction in the outer layer thickness of Casting C and considerable reduction in Castings D and E.

The meltback of the outer layer is to be avoided in that it develops a ragged surface of the SS310 layer as if the grains are broken off in an irregular pattern and redeposited "downstream" by the entering stream of molten T-11 alloy and the strong flow pattern of the centrifugal casting process.

Moreover, the meltback contaminates the inner layer with the ingredients of the outer layer.

Thus, referring to the castings of Table 1, it will be observed that meltback occurred in Castings B to E. However, the meltback of Casting B was very minor and substantially less than that for Castings C to E. Meltback did not occur in Castings A and F.

The ratio in degrees Kelvin was determined for the temperature of the inner face of the SS310 alloy relative to the absolute melting point of the SS310 alloy.

Alloy SS310 has a melting range of about 1400° C. to 1450° C. or an average of about 1425° C. which calculates to an absolute melting point of about 1698° K.

The ratio of the temperature of the inner face of the SS310 alloy to the absolute melting point of the SS310 alloy is given in Table 2 as follows:

TABLE 2

| SS310 melting point 1698° K. | | | |
|---|---|---|---|
| Casting | Temp of Inner Face °K. | Melting Point of SS310 °K. | Ratio of Temp of Inner Face to mp of SS310 °K. |
| A | 1483 | 1698 | 0.873 (87.3%) |
| B | 1593 | 1698 | 0.938 (93.8%) |
| C | 1622 | 1698 | 0.955 (95.5%) |
| D | 1661 | 1698 | 0.978 (97.8%) |
| E | 1666 | 1698 | 0.981 (98.1%) |
| F | 1505 | 1698 | 0.886 (88.6%) |

Meltback occurred in each of Castings B to E, except that the meltback for Casting B was very minor and substantially less than that for C, D and E.

Substantially no meltback occurred in Castings A and F in that the SS 310 layer thickness at the pouring end was the same at the opposite end, and metallographic analysis showed very little, if any, diffusion of one metal into the other in the as-cast condition.

Figure 1:
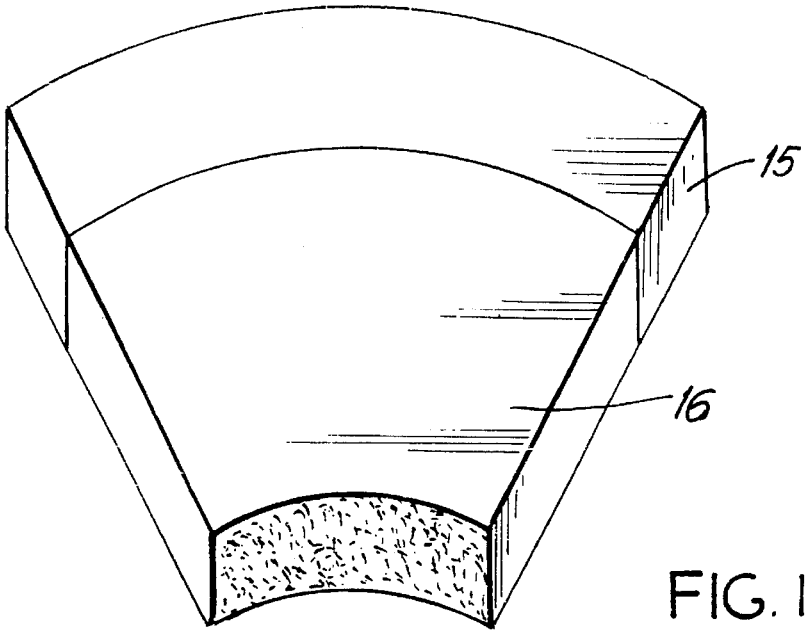
FIGS. 1, 1A and 1B are photographic representations of an arcuate segment of Casting F showing the inner and outer layers in the as-cast state which are not metallurgically bonded as will be apparent from FIGS. 1A and 1B.
Figure 1A:
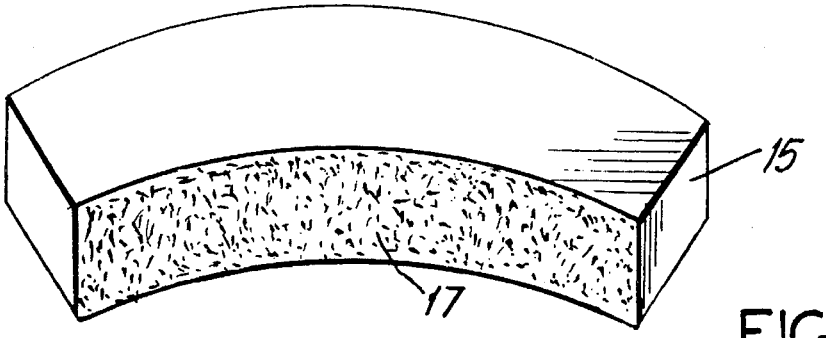
Figure 1B:
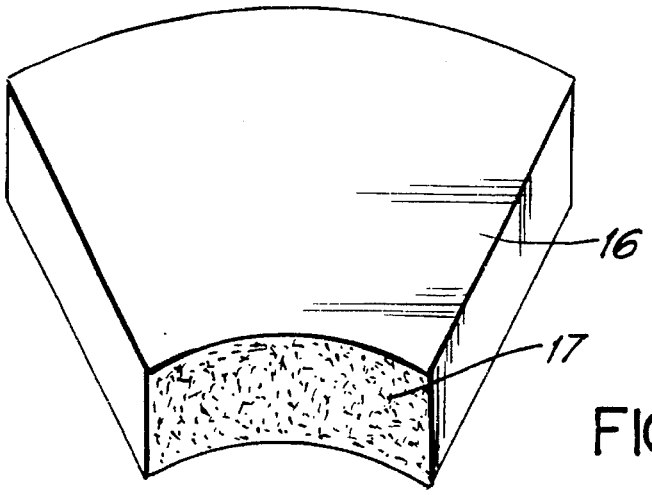

It was observed that when the tube was cut to form a ring, the inner layer could be easily removed by finger pressure, thus confirming that metallurgical bonding did not occur or was substantially inhibited in accordance with applicant's novel inventive concept. This is illustrated by FIGS. 1, 1A and 1B which depict that the outer layer 15 is mechanically separable from inner layer 16. FIG. 1A shows that surface 17 depicts an oxidized as-cast surface, thus confirming that a metallurgical bond did not form between layers following centrifigued casting.

Temperature extrapolations indicated that the ratio of the temperature in degrees Kelvin of the solidified inner face of the outer layer to its absolute melting point following the time it receives the second layer should not exceed about 92% of its absolute melting point.

This is confirmed by the data of Table 2 in which no meltback of the outer layer was observed for Castings A and F and very little for Casting B (93.8% of its absolute melting point).

With respect to Castings A and F, the temperature ratio was 87.3% and 88.6%, respectfully, expressed in degrees Kelvin.

Generally speaking, the temperature of the inner face of the solidified outer layer prior to casting the inner layer may range from about 80% to about 92% of the absolute melting point of the alloy employed as the outer layer.

Where multiple layers are formed-to produce a composite tubular billet, the relationship of the temperature for the inner face of each layer would be correlated to the absolute melting point of the alloy of that layer.

For example, in the production of a three-layered composite tubular billet comprising a first or outer layer, a second or middle layer and a third or inner layer, the relationship is substantially the same in the production of each layer.

Thus, in the casting of the second layer against the inner face of the first or outer layer, the temperature of the inner face of the first layer would not exceed about 92% of the absolute melting point of the alloy composition of the first or outer layer.

Likewise, with respect to the casting of the third or inner layer into the tubular opening of the second or middle layer, the inner face of the middle layer would be controlled at a temperature not exceeding about 92% of the absolute melting point of the alloy used for the second or middle layer.

Generally, the temperature of each of the solidified tubular inner faces into which molten metal is cast centrifugally may range from about 80% to 92% of the absolute melting point of the host layer receiving the molten alloy.

Following the production of the composite tubular casting, it is cut and machined into billets that are mechanically hot worked or hot extruded to the desired size.

Prior to extrusion, the tubular billets are machined to an O.D. of about 8 inches and an I.D. of about 4.0 inches. The billets are then hot extruded to a final tube size of about 2 inches O.D. and 1.5 inches I.D. in a temperature range of about 2100° C. to 2200° F. (about 1150° C. to about 1205° C.).

The extrusion operation was performed on a commercial, horizontal, hydraulic extrusion press with the capacity to exert 5500 tons of force. This press is shown schematically in FIGS. 2 and 2A. One end of the press comprises a massive cylinder, and a ram which is moved forward by water under pressures as high as 4300 psi. The stroke of the ram is about 90 inches, and the movement of the ram is controlled by the operation of a valve which permits the speed of the ram to be varied from 0.1 in./sec to 8 in./sec. Attached to the ram is a hollow stem which fits into the container of the press and which transmits the force of the ram to the metal in the container. The press is provided with a mandrel mover which operates within the ram and which is actuated by high-pressure water; the mandrel is attached to the mandrel mover. The mandrel moves forward and retracts inside the hollow stem.

Mandrels are machined with a slight taper to facilitate their release from the tube at the completion of extrusion.

The end of the stem is protected from the hot billet by an H13 (hot work die steel) "pressing disc" the O.D. of which is 0.060 inch smaller than the I.D. of the liner. The I.D. of the pressing disc is 0.030 inch larger than the O.D. of the mandrel and it is 3–4 inches thick. In addition to the protection of the stem from the heat of the billet, the pressing disc covers the annular space between the I.D. of the hollow stem and the O.D. of the mandrel, thus preventing the hot metal of the billet from "back-extruding" into the stem.

Figure 2:
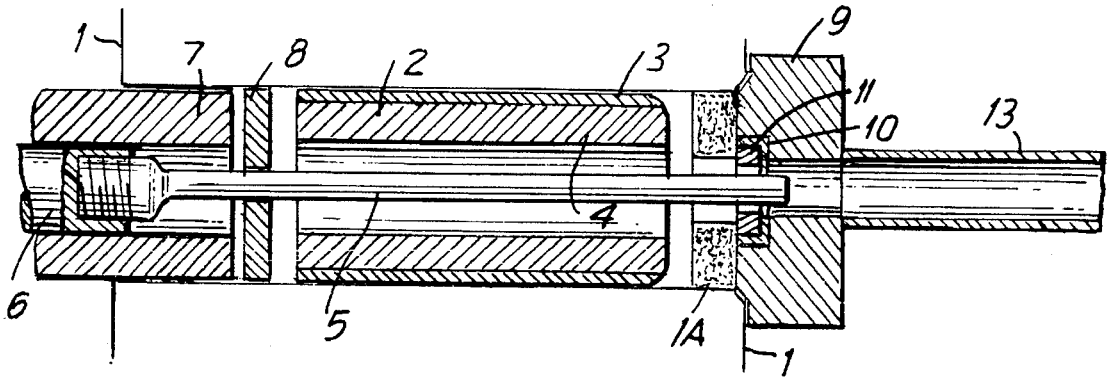
FIGS. 2 and 2A are schematics of the working part of an extrusion device of the type used to produce a multi-layered tubular product of the invention.
Figure 2A:
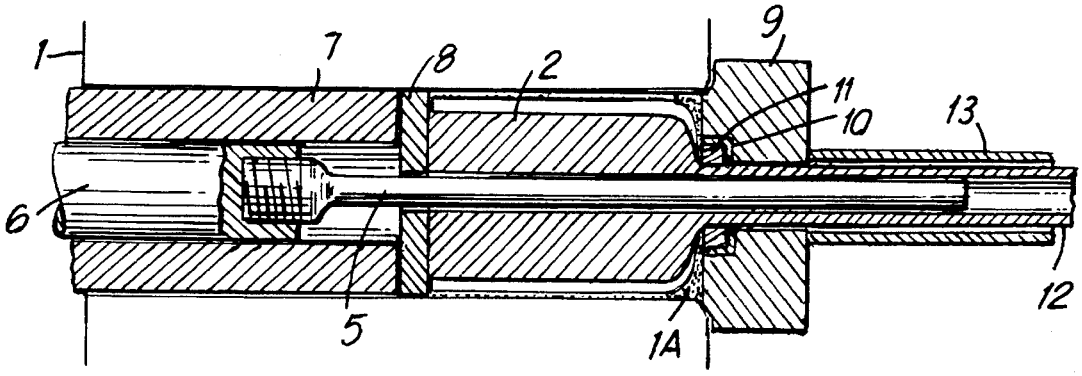

With respect to the above, reference is made to the schematics of FIGS. 2 and 2A.

FIG. 2 shows the confinement of bimetallic billet 2 within container 1 which is not cross hatched for purposes of clarity. A mandrel 5 passes through the hollow interior of the billet, the mandrel being supported by mandrel mover 6 located within stem 7.

As will be noted, a steel pressing disc 8 is disposed between stem 7 and billet 2 such that when the stem and the mandrel mover 6 are moved to the right as shown in FIG. 2A of the drawing, the steel pressing disc is pushed up against the billet to upset the billet as shown.

The hot billet at a temperature of 1175° C. is pushed up against a pad 1A (Briscoe pad) of glass fibers which melt and serve as a lubricant as the upset billet shown in FIG. 2A passes through a die comprising die stack 9 which includes die retainer 10 surrounding die 11.

The billet is upset as shown in FIG. 2A and extrudes as a bimetallic tube 12, a guidetube 13 being provided as shown in FIGS. 2 and 2A. Because of the thinness of the outer SS310 layer, the layer is not shown cross hatched but is referred to by the numeral 12.

The extruded tube exits the die into a guide tube 13 which is essentially a piece of steel pipe; the inside diameter of the pipe is about ¼ inch greater than the outside diameter of the extruded tube and the length is about 4 feet. The purpose of the guide box is to remove any camber in the tube that might occur as it exits the die, and thus produce straight tubes.

The container for the billet carried an alloy-steel (H13) liner with an inside diameter of 8.25 inches; the liner being 42 inches long. Dies made of forged 718 alloy were inserted in the die stack. The mandrels were H13 hot-work die steel heat treated to a hardness of 48–52 HRC. The container wall, the mandrel, and the die were each swabbed with lubricants identified by the tradenames Necrolene and Fiske 60.

Because the inner layer of the bimetallic billet is physically retained inside the outer layer with substantially no melt back of the outer layer into the inner layer, the extruded product is metallurgically bonded by solid state diffusion during hot extrusion of the billet. Owing to the considerable expansion of the interface area between layers during extrusion, any oxide films are fragmented into discrete particles, allowing the two layers to be welded together between the particles as the billet passes through th extrusion die.

Figure 3:
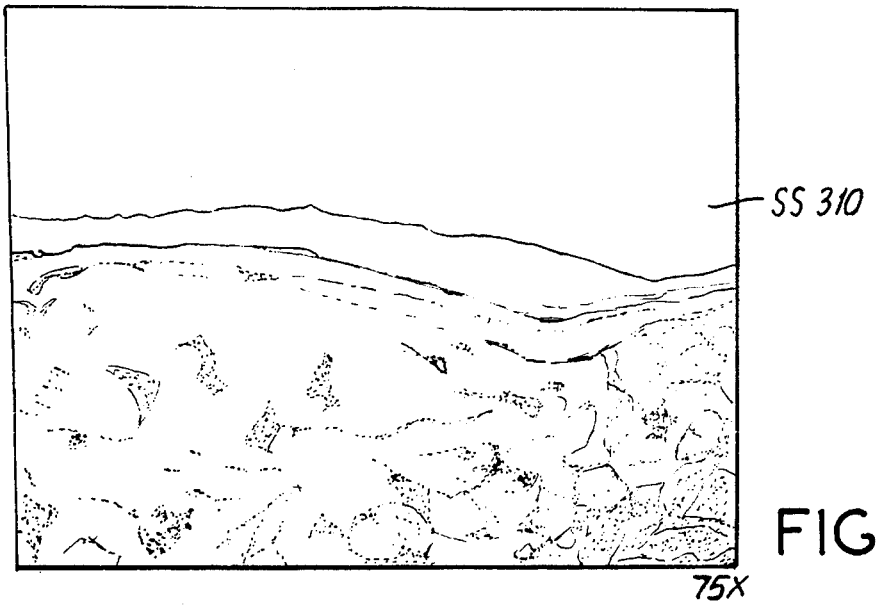
FIG. 3 is a representation of a photomicrograph taken at 75 times magnification showing the substantially non-fused physical relationship in Casting F between the outer layer of type 310 stainless steel and the inner layer of T-11 steel in the as-cast state.

Referring to the photomicrograph of FIG. 3, the cast billet is shown at 75 times magnification.

The upper half of the composite billet is SS310 alloy and the lower half is T-11 alloy. The black space in between is mounting material in preparing the specimen for metallographic analysis.

As will be noted, the inner layer T-11 alloy is not metallurgically bonded to the outer layer of SS310 alloy. The metallurgical bonding occurs during hot extrusion of the billet.

Reference is made to FIGS. 4 and 4A which show a segment of the product helically twisted which illustrates the strength of the bond between layers of the product produced by hot extrusion.

A ring of the extruded product was cut and the periphery severed radially at one location as shown in the left hand section of FIG. 4. The ring was then subjected to severe twisting, i.e., to eleven (11) 90-degree twists made at 0.5-inch intervals around the full circle. As will be apparent from FIG. 4 and the enlargement of FIG. 4A, the metallurgical bonding of one layer to the other was quite strong following hot extrusion.

As regards the physical properties of annealed specimens of alloy F, the results are tabulated in Table 3 below.

TABLE 3

| Tube | Location in Extruded Tube | Tensile Properties of Annealed[a] Specimens from 2-Inch Tubes: 0.2% Offset Yield Strength ksi | Tensile Strength ksi | Elongation % | Reduction of Area, % |
|---|---|---|---|---|---|
| | | T-H Base Metal | | | |
| F-2 | Mid-length | 35.4 | 69.5 | 32.5 | 69.7 |
| | | 42.9 | 73.5 | 29.2 | 67.8 |
| | Average | 39.2 | 71.5 | 31.0 | 69.0 |
| F-3 | Nose end | 42.6 | 72.8 | 27.1 | 67.7 |
| | | 42.5 | 73.7 | 27.4 | 70.8 |
| | Average | 42.6 | 73.3 | 27.5 | 69.5 |
| | Mid-length | 40.8 | 73.2 | 29.2 | 70.2 |
| | | 42.7 | 73.0 | 30.4 | 69.2 |
| | Average | 41.8 | 73.1 | 30.0 | 69.5 |
| | Tail end | 43.6 | 71.9 | 29.7 | 68.6 |
| | | 43.6 | 72.4 | 29.4 | 70.6 |
| | Average | 43.6 | 72.2 | 29.5 | 69.5 |
| Average for all tests | | 41.9 | 70.9 | 29.5 | 68.5 |
| | | Bimetallic Full-Wall | | | |
| F-3 | Mid-length | 46.0 | 79.1 | 32.7 | 56.7[b] |
| | | 46.0 | 81.2 | 31.4 | 52.7[b] |
| | Average | 46.0 | 80.2 | 32.0 | 54.5 |
| Average for all tests | | 43.6 | 77.4 | 33.0 | 54.4 |
| ASTM A 213, Grade T-11 Specification | | 30.0 min | 60.0 min | 29.5 min | — |

[a]Blanks were flattened at 1300° F. (705° C.) held in a protective atmosphere at 1700° F. (927° C.) for 1 hour, furnace cooled, and machined to tensile specimens.
[b]Based on overall final dimensions of fracture. A higher value would be obtained if cross-sectioned area of small gap that developed between layers at the fracture were subtracted from final area.

As illustrative of further embodiments of the invention, reference is made to the following examples.

CASTING G

In another embodiment, the outer layer is a structural steel containing about 1 to 1.25% Mn and up to about 0.3% C and small amounts of Si ranging up to about 1%, said steel having a melting point of about 2750° F. (1510° C.) or 1783° K.

Following casting of the outer layer in the rotating mold as in Castings A to F, the outer layer is solified and cooled so that its inner face reaches a temperature of about 1330° C. or 1603° K. The ratio of the temperature of the inner face of the solified outer layer to its absolute melting point of 1783° K. is about 0.9 or 90% of the absolute melting point.

The inner layer is a stainless steel referred to as 18 Cr—8 Ni stainless having a composition by weight of about 17 to 19% Cr, 8 to 10%, 0.15% C max., 1% Si max., 2% Mn max and the balance substantially iron. This steel is referred to as type 302 stainless and has a melting point ranging from about 2700° F. to 2800° F. or an average temperature of about 2750° (1510° C.) or 1783° K.

CASTING H

A further embodiment is a bi-metallic tube in which the outer layer is a heat resistant alloy referred to as Inconel 625 comprising by weight about 21.5% Cr, 9% Mo, 3.5% Cb+Ta and the balance essentially nickel. The alloy melts in the range of about 2500° F. to 2600° F. or an average of 2550° F. which corresponds to approximately 1400° C. or 1673° K.

The inner layer is T-11 steel which melts at about 2765° F. or about 1518° C.

The outer layer is cast at about 75° C. to 125° C. above its melting point in the centrifugal casting mold as described for castings A to F.

Before casting the inner layer, the outer layer is solidified and cooled to a temperature at its inner face of about 1100° C. or 1472° K.

The ratio of the temperature of 1100° C. or 1373° K. of the inner face to the absolute melting point of the alloy, namely, 1400° C. which is approximately 1673° K, calculates to approximately 0.82 or 82% of the absolute melting point of the alloy of the outer layer.

The alloy of the inner layer , i.e., T-11, is poured into the outer layer while the mold is rotating, the temperature at the time of pouring of T-11 being about 60° C. above its melting point.

The meltback of the outer layer into the inner layer is substantially inhibited, if not avoided.

The multilayered tubing can be produced with a wide variety of steels and heat or corrosion-resistant alloys in any of the layers.

Generally speaking, strong and relatively inexpensive structural steels with relatively little or no alloy content make up the main part of the wall thickness, and provide the main pressure-containing or load-carrying function of the tube. This steel is protected from corrosion or high-temperature scaling by a thinner layer of a more expensive heat or corrosion-resistant cladding layer on the outer and/or inner surface(s). Also, a tougher, less crackprone layer can be placed between other layers as a crack-stopping layer.

The heat and/or corrosion resisting alloys can be in either the outer layer and/or the inner layer, including intermediate crack-stopping or corrosion-stopping layers.

As stated herein, it is preferred in pouring the inner layer that it be poured from the opposite end of the centrifugal casting mold. For example, in a two layer system, the inner layer would be poured in the mold at the opposite end from the pouring of the outer layer. The pouring temperature of the various metals, as stated hereinbefore, preferably range from about 50° C. to 125° C. above the melting point of the metal with the inner layer poured at the lower end of the range.

In the case or producing a three-layered tubular composite, the outer layer would be poured into one end of the centrifugal casting mold, the middle layer would be poured from the opposite end and the last inner layer would be poured in the same end as the outer layer.

Among the materials that can be employed in carrying out the invention included in the aforementioned category are stainless steels, of the types referred to as austenitic stainless steels, super-austenitic stainless steels, duplex stainless steels, ferritic and martensitic stainless steels, iron/nickel-base alloys, nickel-base alloys, nickel/cobalt-base alloys, cobalt-base alloys, etc.

Examples of austenitic heat and/or corrosion resistant alloys are those listed in ASTM A 213 and including TP 201, 202, 304, 309, 310 (as demonstrated herein) 316, 317, 321, 347, 348 and variants thereof, said alloys containing by weight nominally about 17–25% Cr, 8–20% Ni, 0–3.5% Mo, 0–1% Nb, 2% max Mn, 0.75% max Si, 0.15% max C and the balance essentially iron.

Super-austenitic stainless steels are included as variations of the aforementioned austenitic stainless containing, for example, increased amounts of chromium, nickel and molybdenum and often with additions of copper and nitrogen.

Among the duplex stainless steels are included those listed in ASTM A 790 which contain nominally about 18.5–27.5% Cr, about 3.75–7% Ni, about 0.35–4% Mo, 0 to about 2% Cu, about 2.5% max Mn, about 2% max Si, about 0.08% max C with the balance essentially Fe.

The ferritic/martensitic stainless steels contain nominally about 12–26% Cr, 0 to about 2% Mo, 1.5% max Mn, about 1% max Si, about 0.15% max C and the balance essentially Fe.

An example of an iron/nickel-base alloy are those produced under the trademark Incoloy.

Chromium-containing nickel-base alloys include those sold under trademarks Hastelloy, Inconel, Nimonic, etc.

Various structural steels are used to provide the main pressure-containing or load-carrying function of the multilayered tubes. Such steels may, for example, be present as the inner layer, clad externally with a heat or corrosion-resistant alloy as the outer layer, or the tubular billet may be clad internally with such an alloy, or be employed as a middle layer, or clad both externally and internally with one or two such alloys.

Some examples of structural steels are the low alloy chromium-molybdenum heat-resistant steels, listed in ASTM A 213, containing nominally 1–9% Cr, 0.5–1.25% Mo, 1% max Mn, 2% max Si, and 0.25% max C, the balance being essentially Fe. Specific grades are T-2, T-5, T-9, T-11 (used in the demonstration tubes of this invention), T-12, T-17, T-21, T-22, and T-91. Variations of the aforementioned grades containing niobium, vanadium, titanium, boron, or high nitrogen, or any combination thereof, may also be used. Such steels may be referred to as low or medium alloy steels.

Other examples of structural steels as mentioned hereinbefore are (1) the carbon steels of the AISI/SAE 1000 series steels, such as 1005 to 1037, (2) carbon-manganese steels of the AISI/SAE 1500 series and high-strength-low-alloy (HSLA) variations thereof, (3) low-alloy steels of the AISI/SAE 1300, 4000, 5000, 6000, 8000, and 9000 series and special variations thereof, and high-strength-low alloy steels (HSLA).

In summary, the steels and alloys referred to hereinabove for use as either the inner layer, or the middle layer and or the outer layer may be selected from the group consisting of carbon steels, carbon-manganese steels, low alloy steels, high strength low alloy steels, medium alloy steels, stainless steels of the type referred to as austenitic and super-austenitic steels, duplex stainless steels, ferritic stainless steels and martensitic stainless steels, iron/nickel-base alloys, nickel-base alloys, nickel/cobalt-base alloys, and cobalt-base alloys among others.

Where a particular composition is selected for the outer layer a different composition would be selected for the inner layer.

In the case of a 3-layer system, the middle layer would be different in composition from the inner layer and the outer layer would be different in composition from the middle layer. For example, the outer layer may be a heat and/or corrosion resistant alloy, such as a chromium-containing nickel-base alloy or stainless steel. The middle layer may be a high strength low alloy steel and the inner layer may be carbon steel, or a low alloy steel, etc.

Thus, in summary, the alloys employed in carrying out the invention are selected from the group consisting of the structural steels comprising carbon steels, carbon-manganese steels, low alloy steels and high strength low alloy steels; stainless steels, super-austenitic stainless steels, duplex stainless steels, ferritic and martensitic stainless steels; chromium-containing iron/nickel-base alloys, chromium-containing nickel-base alloys, nickel/cobalt-base alloys, and heat and corrosion resistant chromium-containing nickel-base and cobalt-base alloys, the composition of each layer of the composite tabular product being different from the composition of an alloy layer adjacent to said each layer.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed:

1. A method for producing by centrifugal casting an alloy tubular article of manufacture in the form of a composite tubular product comprised of an outer alloy layer of one composition and at least one inner alloy layer of another composition while substantially inhibiting the formation of a metallurgical bond between layers in the as-cast condition which comprises:

providing a rotatable centrifugal casting mold having a first open end and a second open end and a cylindrical inner surface adapted to receive a molten metal alloy, pouring into said first open end of said rotatable mold a first alloy composition of melting point of at least about 1300° C. and centrifugally casting said alloy as a tubular outer layer during rotation of said mold, allowing said outer layer to solidify and cool so that the temperature of its inner face does not exceed about 92% of its absolute melting point in degrees Kelvin, pouring into said tubular outer layer at least one second layer of an alloy of melting point of at least about 1300° C. at a pouring temperature sufficient to form said second layer within said tubular layer interior during rotation of said mold, and cooling said centrifugally cast composite tubular metal product to ambient temperature, said composite tubular product in the as-cast condition being characterized by an interface between said layers in which the formation of a metallurgical bond across said interface has been substantially inhibited.

2. The method of claim 1, wherein said inner layer is poured into the mold through the second open end thereof opposite in direction to the outer layer poured in the first open end.

3. The method of claim 1, wherein said alloy of each of said first layer and said at least one second layer is selected from the group consisting of structural steels comprising carbon steels, carbon-manganese steels, low alloy steels and high strength low alloy steels; stainless steels including austenitic stainless steels, super-austenitic stainless steels, duplex stainless steels, ferritic and martensitic stainless steels; chromium-containing iron/nickel-base alloys, chromium-containing nickel-base alloys, nickel/cobalt-base alloys, and heat and corrosion-resistant chromium-containing nickel-base, iron/nickel-base and cobalt-base alloys, the composition of each layer of the composite tabular product being different from the composition of an alloy layer adjacent to said each layer.

4. The method of claim 3, wherein said inner or said outer layer is a structural low alloy steel.

5. A method for producing by centrifugal casting an alloy tubular article of manufacture in the form of a composite-tubular product comprised of an outer alloy layer of one composition of melting point of at least about 1300° C. and at least one inner alloy layer of another composition of melting point at least about 1300° C. while substantially inhibiting the formation of a metallurgical bond between layers in the as-cast condition which comprises:

providing a rotatable centrifugal casting mold having a cylindrical inner surface and having a first open end and a second open end adapted to receive a molten metal alloy, pouring into the first open end of said rotatable mold a first alloy composition of melting point of at least about 1400° C. and centrifugally casting said alloy to form a tubular outer layer during rotation of said mold, allowing said tubular outer to solidify so that its inner face has a temperature not exceeding about 92% of the absolute melting point in degrees Kelvin of said alloy, pouring into said solidified outer layer at least one second layer of an alloy of melting point of at least about 1300° C. and thereby forming a casting of said composite tubular metal product thereof, said alloy of each of said first layer and at least one second layer being selected from the group consisting of structural steels comprising carbon steels, carbon-manganese steels, low alloy steels and high strength low alloy steels; stainless steels including austenitic stainless steels, super-austenitic stainless steels, duplex stainless steels, ferritic and martensitic stainless; chromium-containing iron/nickel-base alloys, Chromium-containing nickel-base alloys, nickel/cobalt-base alloys, and heat and corrosion resistant chromium-containing nickel-base and cobalt base alloys, the composition of each layer of the composite tabular product being different from the composition of an alloy layer adjacent to said each layer, and cooling said centrifugally cast composite tubular metal product to ambient temperature, said composite tubular product in the as-cast condition being characterized by an interface between said layers in which the formation of a metallurgical bond across said interface has been substantially inhibited.

6. The method of claim 5, wherein said composite tubular product is produced by employing a heat or corrosion-resistant alloy as the outer layer.

7. The method of claim 5, wherein said outer-layer is produced by employing a nickel/chromium steel.

8. The method of claim 5, wherein said outer layer is produced by employing a low alloy steel.

9. The method of claim 6, wherein said inner layer is produced by employing a low alloy steel.

10. The method of claim 5, wherein said outer layer is produced by employing a heat resistant alloy selected from the group consisting of chromium-containing nickel-base, iron/nickel base, cobalt-base and iron-base alloys.

11. A method for producing by centrifugal casting an alloy tubular article of manufacture in the form of a composite tubular product comprised of an outer alloy layer of one composition and at least one inner alloy layer of another composition while substantially inhibiting the formation of a metallurgical bond between layers in the as-cast condition which comprises:

providing a rotatable centrifugal casting mold having a cylindrical inner surface adapted to receive a molten metal alloy, pouring into said rotatable mold a first alloy composition of melting point of at least about 1300° C. and centrifugally casting said alloy to form a tubular outer layer during rotation of said mold, allowing said tubular outer layer to solidify so that its inner face has a temperature not exceeding about 92% of its absolute melting point in degrees Kelvin, pouring into said tubular outer layer at least one second layer of an alloy of melting point of at least about 1300°

C. at a pouring temperature sufficient to form said second layer within said tubular outer layer during rotation of said mold, said pouring temperature of each of the layers ranging from about 50° C. to 125° C. above the melting point of each of said alloys, the pouring temperature of the outer layer being at the upper end of the range and the pouring temperature of the inner layer being at the lower end of the range, and cooling said centrifugally cast composite tubular metal product to ambient temperature, said composite tubular product in the as-cast condition being characterized by an interface between said layers in which the formation of a metallurgical bond across said interface in the as-cast condition has been substantially inhibited, and subjecting said cast composite tubular product to reduction by hot mechanical working and thereby produce a composite tubular product of predetermined inner and outer diameters.

12. The method of claim 11, wherein said mechanical working is achieved by hot extrusion.

13. The method of claim 11, wherein said alloy of each of said first layer and said at least one second layer is selected from the group consisting of structural steels comprising carbon steels, carbon-manganese steels, low alloy steels and high strength low alloy steels; stainless steels including austenitic stainless steels, super-austenitic stainless steels, duplex stainless steels, ferritic and martensitic stainless steels; chromium-containing iron/nickel-base alloys, chromium-containing nickel-base alloys, nickel/cobalt-base alloys, and heat and corrosion resistant chromium-containing nickel-base and cobalt base alloys, the composition of each layer of the composite tabular product being different from the composition of an alloy layer adjacent to said each layer.

14. The method of claim 13, wherein said outer layer is a nickel/chromium steel.

15. The method of claim 14, wherein said inner layer is a low alloy steel.

16. A method for producing by centrifugal casting and hot extrusion an alloy tubular article of manufacture in the form of a composite tubular product comprised of an outer alloy layer and at least one inner alloy layer while substantially inhibiting the formation of a metallurgical bond between layers in the as-cast which comprises:

providing a rotatable centrifugal casting mold having a cylindrical inner surface adapted to receive a molten metal alloy, pouring into said rotatable mold a first alloy composition of melting point of at least about 1400° C. and centrifugally casting said alloy as a tubular outer layer during rotation of said mold, allowing said outer layer to solidify so that the temperature of its inner face does not exceed about 92% of its absolute melting point in degrees Kelvin of said alloy, pouring into said tubular outer layer a second layer and after solidification and cooling of the second layer to a temperature at its inner face not exceeding about 92% of its absolute melting point followed by pouring a third inner layer alloy having a melting point of at least about 1300° C. and at a pouring temperature ranging from about 50° C. to 75° C. above the melting point of said third inner layer alloy and thereby form a casting of said composite tubular metal product thereof comprised of a first outer layer and a second and third inner layer, and cooling said centrifugally cast composite tubular metal product to ambient temperature, said composite tubular product in the as-cast condition being characterized by interfaces between said layers in which the formation of a metallurgical bond across each of said interfaces has been substantially inhibited and subjecting said cast composite tubular product to reduction by hot extrusion at an elevated temperature sufficient to produce a product of predetermined inner and outer diameter characterized by a metallurgical bond across the interfaces thereof produced by solid state diffusion during hot extrusion.

17. The method of claim 16, wherein said outer-layer is produced by employing a nickel/chromium steel as the outer layer.

18. The method of claim 17, wherein the outer layer of said composite tubular is 310 stainless steel.

19. The method of claim 16, wherein at least one of said inner layers is a low alloy steel.

20. The method of claim 16, wherein said outer layer is produced by employing a heat resistant alloy selected from the group consisting of chromium-containing nickel-base, cobalt-base and iron-base alloys.

* * * * *